United States Patent [19]

Nespor

[11] 4,392,059

[45] Jul. 5, 1983

[54] AUTOMATIC REMOTE CAR STARTER

[76] Inventor: Tony Nespor, 2515 Glencoe Rd., Baltimore, Md. 21234

[21] Appl. No.: 195,259

[22] Filed: Oct. 8, 1980

[51] Int. Cl.[3] ..... F02N 11/08

[52] U.S. Cl. ..... 290/38 D; 123/179 BG; 290/38 C

[58] Field of Search ..... 123/179 B, 179 BG; 290/DIG. 3, 38 C, 38 D, DIG. 8; 180/167

[56] References Cited

U.S. PATENT DOCUMENTS

| | | | |
|---|---|---|---|
| 2,992,335 | 7/1961 | Boucher | 290/38 D |
| 3,455,403 | 7/1969 | Hawthorne | 290/DIG. 3 |
| 3,862,429 | 1/1975 | Bucher | 123/199 B |
| 4,236,594 | 12/1980 | Ramsperger | 290/DIG. 3 |

*Primary Examiner*—Gene Z. Rubinson
*Assistant Examiner*—Shelley Wade
*Attorney, Agent, or Firm*—Alan M. Friedman

[57] ABSTRACT

A system for remote starting of an internal combustion engine including remote means for initiating the starting sequence which may comprise a radio receiver in combination with a remote transmitter. Upon receiving the signal from the transmitter, a series of digital pulses is initiated which pulses are counted and translated into a set of sequential outputs. Certain of these digital outputs are utilized to initiate the provision of fuel to the internal combustion engine, the provision of power to a starting device for the engine, as well as the provision of ignition power. Means are further provided which are responsive to the actual ignition of the engine and serve to inhibit effectively further attempts to start the engine by the automatic starting system. Additionally, means may be provided for inhibiting subsequent attempts to start the engine after a predetermined number of starting attempts have failed, in order to prevent discharge of the starting battery.

7 Claims, 1 Drawing Figure

AUTOMATIC REMOTE CAR STARTER

BACKGROUND OF THE INVENTION

The present invention relates to remote starting systems for internal combustion engines and is particularly directed towards a radio controlled system for the remote ignition of such an engine in a manner such as to provide more control over the starting sequence thereof than has been previously possible.

It is well known that under the circumstances of cold, wet, or otherwise inclement weather the internal combustion engine of an automobile, truck, etc., can be very difficult to start or may be to some degree inaccessable when weather conditions are extreme. A relatively heavy snow, for example, especially under extremely cold temperatures makes it quite inconvenient to get to, clean off and start a frozen, snow covered automobile. In many instances, it is necessary to make at least two trips out to the vehicle, the first trip approximately fifteen minutes to a half-hour prior to using the car to get it started, allowing it to warm up to operating temperature before use.

Remote control starting systems have been disclosed in the prior art and in many cases utilize long cables which are used to transmit control signals to the automatic starter system and which cables must be laid, for example, from the automobile to the inside of the home in anticipation of inclement weather conditions. In some instances, radio control has replaced such cable connected control units and the automatic starter system is activated by radio signals. In one of these systems, that disclosed in U.S. Pat. No. 3,577,164, transmitted radio signals may comprise a plurality of audio frequencies which are effective to perform particular functions in the automatic system. In that disclosure, it is necessary to transmit several distinct radio signals, a first one of which is purely a check signal to establish that the automobile is within range of the transmitter whereby a second signal is provided to energize the automobile ignition circuit and a third transmitted radio signal functions to actuate a gas-pedal solenoid to supply fuel to the engine. Such use of a plurality of transmitted signals each performing an isolated function increases the possibility of one or more of these functions causing difficulty and inhibiting the entire starting sequence.

In other prior art systems such as in U.S. Pat. No. 3,553,472, an optional radio control unit may be utilized to send a plurality of signals each with a different frequency and each capable of initiating a particular function. In this system, as in the one described above, the starting sequence is not fully automatic in that each stage must be separately initiated by transmission of a distinct signal.

SUMMARY OF THE INVENTION

The present invention provides a fully automatic vehicle starting system which is capable of performing all functions otherwise necessarily initiated by an occupant of the vehicle. All of these functions, furthermore, are initiated in their proper sequence by a single radio transmitted signal to the automatic starting system.

A single initial signal from the transmitter functions to turn on power to the automatic starting system and initializes a number of circuit components, including several counters and timers. A first timer is operative as a multi-vibrator providing a series of continuous pulses to the system and this timer functions as a clock providing a frequency upon which the remainder of the starting logic bases its synchronization.

A first decade counter counts these pulses directly and translates them into a set of sequentially counting digital outputs. Certain of these digital outputs engage, through appropriate circuitry, a gas-pedal solenoid which may pump the gas-pedal several times. Certain other digital outputs are operative to provide power to the ignition, while certain remaining outputs of the first counter are operative through appropriate circuitry to operate a solenoid which serves to engage the starter motor.

If the vehicle engine starts, a vacuum switch is operated and functions to disconnect further power to the logic circuitry and to the starter solenoid. The vacuum switch also provides power to the vehicle heater and the ignition is also powered directly through the vacuum switch, rather than through the logic circuitry.

If the first starting cycle fails to start the vehicle engine, the first pulse following completion of the starting cycle returns the decade counter to its initial state and begins the digital outputs full sequence once again. Each of these full starting attempts is counted by a second decade counting means and this counter acknowledges a predetermined number of starting sequences by causing a certain one of its outputs to reset the first counter and hold it in the reset state thus inhibiting further attempts to start the vehicle engine, and thus eliminating any possibility of running down the battery if the engine is experiencing some starting problem. Another series of starting attempts may be initiated only by the transmission of another starting signal from the remote transmitting unit.

When the vehicle engine is started and the vacuum switch operates, power is provided to the timing components of the second timer and begins to charge the timing capacitor thereof. After some predetermined time interval dependent on the RC time constant of the circuit, the timer operates the gas-pedal solenoid, pumping the gas and resetting the automatic choke. This sequence is repeated periodically at approximately the initial time interval.

Upon the engine reaching a preset temperature, a thermoswitch will operate to remove power to the vacuum switch and thus to the ignition, heater, etc. This completes the entire automatic starting sequence, and even subsequent to the thermo-switch returning to its normally closed low temperature position, the starting sequence will not be reinitiated except by another signal received from the remote transmitter.

It is thus an object of the present invention to provide a fully automatic internal combustion engine starting system which is initiated by a single signal and not only completes a full starting cycle without further remote input, but will repeat such complete start cycles up to a predetermined number and then stop, all based on a single initiating signal.

It is a further object of the present invention to provide a remote starting system which during a single starting cycle automatically operates a gas-pedal several times setting an automatic choke, and subsequently provides ignition power and starter motor power automatically.

Another object of the present invention is to provide a remote starting system which automatically turns on the interior vehicle heater, if desired, upon successful ignition of the engine.

A further object of the present invention is to provide a remote starting system which, subsequently to ignition of the vehicle engine, functions to automatically reset the automatic choke of the engine periodically.

Still another object of the present invention is to provide a remote starting system which functions to shut off the engine of the vehicle when it has reached operating temperature, removing power from all systems if the driver is delayed in occupying the vehicle.

Further advantages and objects of the present invention will become obvious and the functioning and organization thereof will be best understood by reference to the following description of a preferred embodiment taken in combination with the accompanying drawing.

DETAILED DESCRIPTION OF THE PREFERRED EMBODIMENT

Figure 1:
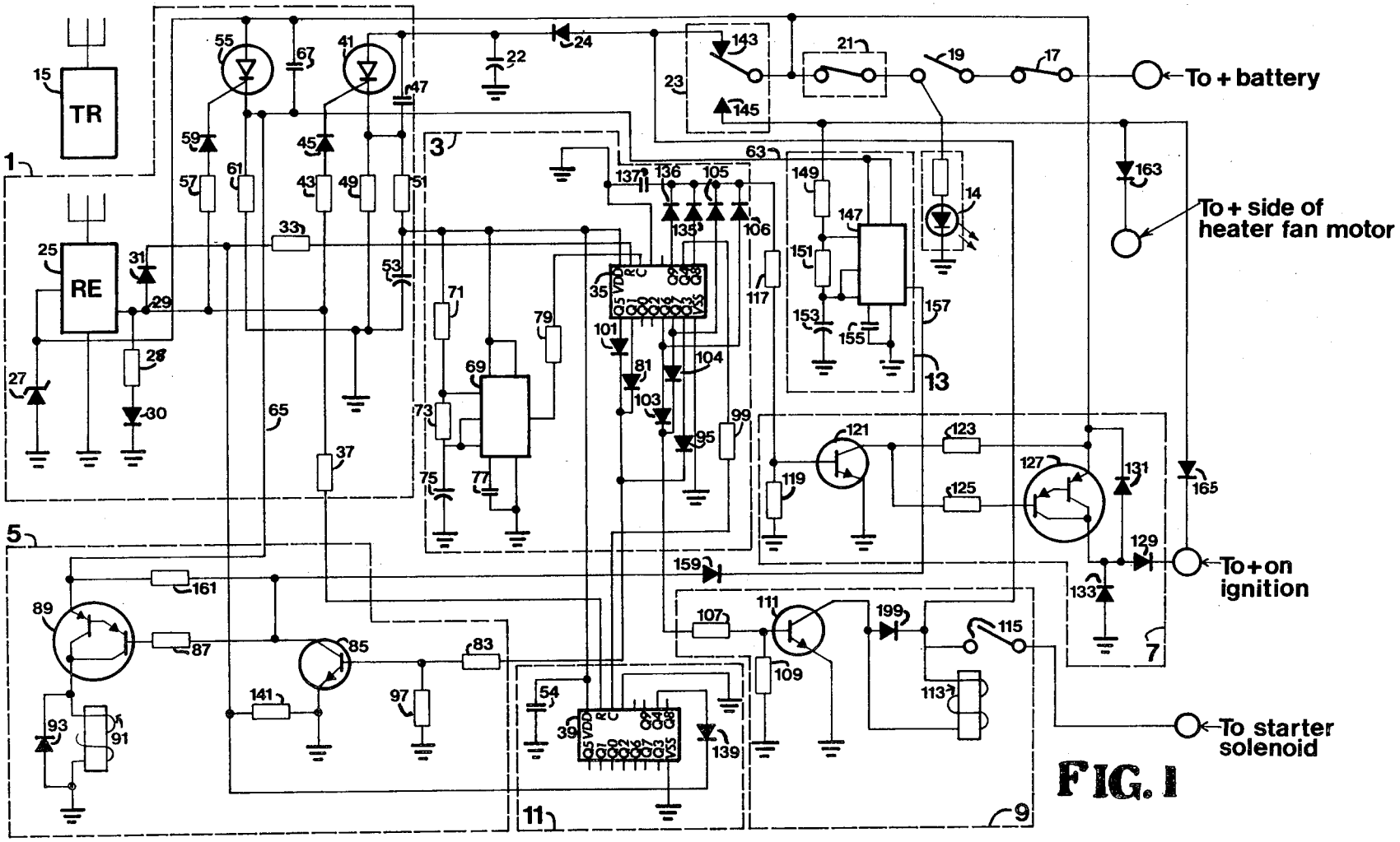
FIG. 1 is a schematic diagram of a preferred embodiment of the present invention.

Referring to FIG. 1, the present system is divided for clarity into an organization of functional blocks indicated by the dotted lines.

These functional sections comprise the receiving and initializing section 1, the pulse generation and counting section responsible for individual starting cycles 3, the section responsible for operation of the gas-pedal 5, which may also serve to operate the automatic choke, the section of the circuit which provides ignition power to the ignition circuitry of the engine 7, circuitry which operates to provide power to the starting motor of the engine 9, a second counting section 11 which serves to count complete starting cycles up to a predetermined number, a second timing section 13 which serves to periodically, upon completion of a predetermined time interval, activate the gas-pedal solenoid and thus reset the automatic choke.

Other portions of the automatic remote starting system of the present invention include the LED power indicator 14, transmitter 15 for initiating starting sequences, as well as power switches which include an interlock switch 17 for preventing engagement of the automatic starting circuit when the shift lever of the transmission is not in the park or neutral position, a manual power switch 19 for disconnecting all power from the automatic circuitry for either normal driving or extended periods of parking, a thermo-switch 21 for disconnecting power to the circuitry subsequent to the engine reaching operating temperature, and a vacuum switch 23 which operates upon ignition of the engine and simultaneously removes power from the receiving section and logic circuitry and supplies power to the timing elements of the second timing section 13 as well as to the heater of the vehicle. Also present are a filtering capacitor 22, and a diode for maintaining power polarity 24.

Radio frequency receiver 25, which receives power regulated by zener diode 27, initializes the automatic starting circuitry by a signal present at 29. The voltage is kept within desired levels by resistor 28 and diode 30. This voltage is applied as a reset signal through diode 31 and resistor 33 to first counting means 35 as well as a reset signal which is applied through resistor 37 to second counting means 39. This initializing signal present at 29 also serves to turn on a silicon controlled rectifier 41 through resistor 43 and diode 45. Associated with this signal SCR 41 is a filtering bypass capacitor 47 to eliminate possible voltage spikes, as well as resistor 49 which serves to provide a minimum load for SCR 41 as well as to, in combination with resistor 51 and capacitor 53, function as a filtering network for power supplied to the pulse generation and counting section 3 and second counting section 11. The power to both sections is further filtered by capacitor 54.

Initializing at 29 also turns on silicon controlled rectifier 55 through resistor 57 and diode 59. SCR 55 has a load resistor 61, and supplies power at 63 to the second timer as well as at 65 to the section dealing with operation of the gas-pedal and automatic choke 5. SCR 55 also has an associated bypass capacitor 67.

Subsequent to initialization, pulse generation and counting section 3 operates to begin a first starting cycle as follows. After first counter 35 and first timer 69 receive power and counter 35 is reset through resistor 33, a series of digital pulses begins to be generated by first timing means 69 which is operated as a multivibrator The frequency of this series of pulses is determined by resistor 71, resistor 73 and capacitor 75 and is choosen to provide most effective operation sequentially of the vehicle engine's controls. Capacitor 77 bypasses a portion of the timer circuit to ground. The steady pulse sequence is applied through resistor 79 to the counting input of first counter 35. Counter 35, which in this embodiment is a decade counter, has ten outputs which sequentially and exclusively present a positive voltage, and which are designated Q0 through Q9. The counter is in the Q0 state upon reset. Upon receiving the initial pulse, output Q1 is set high and through diode 81 and resistor 83 applies a positive voltage to the base of transistor 85 causing it to conduct and through resistor 87, to turn Darlington transistor pair 89. This causes current to flow through gas-pedal solenoid 91 thus causing an activation or pumping of the gas-pedal of the vehicle. Solenoid 91 is bypassed by diode 93 in order to supress voltage spikes.

While the second pulse received by counter 35 is ignored by the circuitry since Q2 has no connection in this embodiment, the third pulse counted causes a positive voltage to be applied through diode 95 and resistor 83, to again activate solenoid 91 as described above. It may be noted that the bias on the base of transistor 85 when turned off, is maintained at near ground potential by resistor 97. With the input of another pulse to counter 35, output Q4 provides a positive voltage through resistor 99 to the counting input of second counter 39. While a complete starting cycle has not yet been completed, in the present embodiment the starting cycles are counted after two activations of the gas-pedal solenoid 91 and prior to a third activation thereof occurring on output state Q5 through diode 101. The counting of the cycle is also followed by the application of a positive voltage from Q6 to the starter motor section 9 through diode 103 as well as the simultaneous application of a voltage from Q6 to the section activating the ignition 7 through diode 106. With the next pulse, Q7 goes high maintaining both functions performed by Q6 through diodes 104 and 105 respectively.

In the activation of the starter motor of the vehicle by circuitry shown generally at 9, the voltage from the Q6 and Q7 outputs of counter 35 are applied through resistor 107 which operates in conjunction with base resistor 109 to cause conduction in transistor 111. This completes the conduction path of relay 113 causing its contacts 115 to close and allowing power to flow to the starter motor of the engine. Diode 114 supresses voltage transients.

Simultaneously to the starter motor being activated by output states Q6 and Q7, these same voltages are applied through resistor 117 and with resistor 119 providing bias, serve to turn on transistor 121 which in turn through resistors 123 and 125 negatively biases Darlington transitor pair 127 into conduction. This causes ignition power to be available to the ignition circuits of the internal combustion engine at the same time that the starter motor is engaged. This ignition power also passes through polarity diode 129 and it may be additionally noted that voltage spikes due to switching at this point are suppressed by diodes 131 and 133.

It is to be noted that the starter motor of the engine is engaged only on output states Q6 and Q7 and the next two pulses cause states Q8 and Q9 to provide a positive voltage which is applied through diodes 135 and 136 in order to keep the ignition of the engine on until the next cycle of counter 35 begins.

It may also be noted at this point that diodes 81, 95, 101, 103, 104, 105, 106, 135 and 136 each function to prevent a positive voltage from any one output from reaching any other output while it is turned off, and effectively function as OR inputs. Any transient voltage spikes where the junction of a number of the diodes apply a voltage to ignition section 7, are prevented by capacitor 137.

Upon the first pulse after the Q9 state, counter 35 once again attains the Q0 state and then, in sequence, the Q1 state which once again through diode 81 activates the gas-pedal solenoid, output Q2 which is passive, and output Q3 which similarly activates the gas-pedal. At this point, output Q4 is raised to a positive voltage once again incrementing second counter 39. Counter 39 which, from the initiation of the present starting sequence has now counted two starting cycles, but only one complete starting attempt, now has output Q2 high which continues its passive condition, since oututs Q0 through Q3 and Q5 through Q9 have no connection. It is only the Q4 output, in this embodiment, of counter 39 which goes high after three complete starting attempts and two additional gas-pedal activations, providing a positive voltage which, through diode 139, is applied to the reset input of counter 35 through resistor 33. In the absence of such a positive voltage from Q4 of counter 39, resistor 141 keeps this reset line at or near ground potential. It may furthermore be noted that when Q4 of counter 39 is high, diode 31 serves to prevent the reset signal from reaching point 29 and thus prevents counter 39 from resetting itself through resistor 37.

Thus, if the engine has not started after three complete starting attempts and two additional gas-pedal pumps, counter 39 resets counter 35 and holds it in the Q0 state indefinitely inhibiting any further attempts at starting until another initializing signal is sent from transmitter 15 to receiver 25 causing a reset signal again at 29 which resets counter 39 as well as initializing the other components and beginning the entire sequence again.

Should the engine of the vehicle start during any one of the three starting attempts, vacuum switch 23 will be activated by the manifold vacuum of the engine and will disengage power from contact 143 and thus from SCR 47 which powers the logic of sections 3 and 11, and apply power to contact 145 and thus to the timing components of timing section 13 which begins to periodically activate the gas-pedal solenoid and reset the automatic choke. The timing circuit of second timer 147 consists of resistor 149 and 151 as well as capacitor 153. A portion of the timer circuit is bypassed by capacitor 155.

As capacitor 153 charges to the proper level, timer 147 completes its cycle and its output 157 is pulled negatively and through diode 159, activates the gas-pedal solenoid 91 by causing resistor 87 and resistor 161 to set a conductive bias on Darlington transistor pair 89. This adjusts the automatic choke and is periodically repeated at an interval determined by the RC constant associated with timer 147.

When the vacuum switch applies power to contact 145, the heater of the vehicle is also activated through diode 163 and additionally, power continues to flow to the ignition of the engine through diode 165.

Upon the engine reaching operating temperature and the interior of the vehicle consequently becoming heated, thermo-switch 21 will open at its preset temperature removing power both from SCR 55 and from vacuum switch 23. The engine will now stop and the vacuum switch will return to its initial position. The entire starting and warm-up sequence has now been completed and even should thermo-switch 21 cool and reclose, the starting sequence will not be reinitiated unless another signal is transmitted to receiver 25.

Having thus described a preferred embodiment considered to exemplify the practice of the invention, it should be understood that many changes and modifications may be made within the spirit of the present invention, the scope of which is intended to be defined and limited only by the appended claims.

What is claimed is:

1. A system for remote starting of an engine, comprising:

a. engine starting means which includes:
- means for initiating a series of digital pulses;
- means for activating said digital pulse means;
- counting means for counting said series of digital pulses and for translating them into a set of of sequential outputs;
- means responsive to certain of said outputs for providing fuel to the engine; and
- means responsive to certain of said outputs for providing power to a starting device for the engine; and b. means controlled by the engine being operated by the starting device, said engine controlled means providing ignition power to the engine and removing power from said engine starting means and the starting device.

2. A system as recited in claim 1 further comprising:
- second counting means for counting changes in the state of at least one of said sequential outputs; and
- means responsive to said second counting means for providing an output which inhibits further attempts to start the engine subsequent to a predetermined number of starting attempts.

3. A system as recited in claim 1 wherein said engine controlled means further provides power to a vehicle heater and to said said counting means.

4. A system as recited in claim 1 wherein said means for providing fuel to the engine includes:
- solenoid means for pumping a gas-pedal linkage, and
- means for periodically activating said solenoid means in order to pump said gas-pedal linkage and thereby periodically reset an automatic choke subsequent to ignition of the engine.

5. A system as recited in claim 1 further comprising means responsive to the temperature of the interior of the vehicle for stopping the engine and the vehicle heater in response to the interior of the vehicle attaining a predetermined temperature.

6. A system as recited in claim 1 wherein said engine controlled means provides power to activate a vehicle heater subsequent to ignition of the engine.

7. A system for remote starting of an engine employing a cycle of automatically sequenced starting operations as described in claim 1 wherein:

said digital pulse initiating means includes a radio frequency transmitter and a radio frequency receiver, said receiver supplied with power protected from voltage spikes by a Zener diode;

said digital pulse activating means includes a first timer started by a signal from said receiver and providing a series of digital pulses;

said counting means incudes a first counter receiving said series of digital pulses from said first timer and translating said digital pulses into a set of sequential outputs for a cycle of automatically sequenced starting operations; said counting means also includes a second counter receiving a digital pulse from said first counter each time a complete cycle of automatically sequenced starting operations has been completed for halting starting operations when a predetermined number of cycles has been completed;

said means responsive to certain of said outputs for providing fuel to the engine in a gas pedal solenoid controlled by a Darlington transistor pair controlled by outputs of said first counter; said solenoid being periodically activated under the further control of a second timer controlled by means controlled by the engine;

said means responsive to certain of said outputs for providing power to a starting device for the engine is a relay controlled by a transistor receiving controlling pulses from said first counter; and said means controlled by the engine is a vacuum operated switch.

* * * * *